United States Patent [19]

Weber et al.

[11] Patent Number: 4,772,884

[45] Date of Patent: Sep. 20, 1988

[54] INDEPENDENT SUSTAIN AND ADDRESS PLASMA DISPLAY PANEL

[75] Inventors: Larry F. Weber, Champaign, Ill.; Richard C. Younce, South Bend, Ind.

[73] Assignee: University Patents, Inc., Westport, Conn.

[21] Appl. No.: 787,541

[22] Filed: Oct. 15, 1985

[51] Int. Cl.[4] ..... G09G 3/28

[52] U.S. Cl. ..... 340/776

[58] Field of Search ..... 340/776, 769, 772, 703, 340/768, 712, 779; 315/169.4

[56] References Cited

U.S. PATENT DOCUMENTS

| | | | |
|---|---|---|---|
| 3,559,190 | 1/1971 | Bitzer et al. . | |
| 3,839,714 | 10/1974 | Janning . | |
| 3,851,210 | 11/1974 | Schermerhorn . | |
| 3,886,404 | 5/1975 | Kurahashi et al. | 340/779 |
| 3,898,515 | 8/1975 | Andoh et al. . | |
| 3,925,703 | 12/1975 | Schermerhorn . | |
| 3,971,013 | 7/1976 | Challoner et al. | 340/712 |
| 4,044,349 | 8/1977 | Andoh et al. . | |
| 4,121,135 | 10/1978 | Hunt et al. . | |
| 4,190,788 | 2/1980 | Yoshikawa et al. . | |
| 4,328,489 | 5/1982 | Ngo . | |
| 4,430,601 | 2/1984 | Boyd et al. . | |
| 4,513,281 | 4/1985 | Ngo | 340/703 |
| 4,591,847 | 5/1986 | Criscimagna et al. | 340/776 |

FOREIGN PATENT DOCUMENTS

| | | | |
|---|---|---|---|
| 2129595 | 5/1984 | United Kingdom | 340/776 |

OTHER PUBLICATIONS

Schermerhorn, J. D. and Miller, J. W., "Discharge-Logic Drive Schemes", IEEE Transactions on Electron Devices, vol. ED-22, No. 9, Sep. 1975, pp. 669-673.

Ngo, P. D., and Maliszewski, S. R., "Electron Transport Self-Shift Display Using an AC Plasma Panel", Proceedings of the SID, vol. 22/4, 1981, pp. 240-246.

Ngo, Peter, D. T., "Charge Transport in an AC Plasma Panel", Proceedings of the SID, vol. 22/4, 1981, pp. 233-239.

Ngo, Peter D. T., "Bidirection Shift Plasma Display Requiring Less Than 20 Drivers", IEEE Transactions on Electron Devices, vol. ED-32, No. 6, Jun. 1985, pp. 1077-1081.

Coleman, W. E., and Hall, S. W., "Device Characteristics of the Plasma Charge Transfer Shift Display", Proceedings of the SID, vol. 22/4, 1981, pp. 247-253.

*Primary Examiner*—Marshall M. Curtis
*Assistant Examiner*—Mahmoud Fatahiyar
*Attorney, Agent, or Firm*—George M. Yahwak

[57] ABSTRACT

An AC gas discharge display panel is described which employs the phenomenon of plasma spreading. In the panel, plasma spreading or "coupling" is employed to couple the plasma to an addressed cell to one of a plurality of pixels to be illuminated. The spreading is controlled by assuring that the cell wall voltages are properly related so that the plasma's electrons migrate to a region where the voltages are approximately equal to or more positive than the wall voltages where the plasma originated. Paired sustain electrodes are selectively energized to enable diversion of the coupled plasma to the desired pixel, so that upon subsequent applications of a sustain voltage, the desired pixel is illuminated (or erased) as the case may be.

28 Claims, 8 Drawing Sheets

INDEPENDENT SUSTAIN AND ADDRESS PLASMA DISPLAY PANEL

This invention relates to gas discharge panels and, more particularly to gas discharge panels which make use of plasma coupling for write and erase cycles.

BACKGROUND OF THE INVENTION

Plasma display panels, or gas discharge panels, are well known in the art and, in general, comprise a structure including a pair of substrates respectively supporting thereon column and row electrodes each coated with a dielectric layer such as a glass material and disposed in parallel spaced relation to define a gap therebetween in which an ionizable gas is sealed. Moreover, the substrates are arranged such that the electrodes are disposed in orthogonal relation to one another thereby defining points of intersection which in turn define discharge cells at which selective discharges may be established to provide a desired storage or display function. It is also known to operate such panels with AC voltages and particularly to provide a write voltage which exceeds the firing voltage at a given discharge point, as defined by a selected column and row electrode, thereby to produce a discharge at a selected cell. The discharge at the selected cell can be continuously "sustained" by applying an alternating sustain voltage (which, by itself is insufficient to initiate a discharge). This technique relies upon the wall charges which are generated on the dielectric layers of the substrates which, in conjunction with the sustain voltage, operate to maintain discharges.

Details of the structure and operation of such gas discharge panels or plasma displays are set forth in U.S. Pat. No. 3,559,190 issued Jan. 26. 1971 to Donald L. Bitzer, et al.

In the past two decades, AC plasma displays have found widespread use due to their excellent optical qualities and flat panel characteristics. These qualities have made plasma displays a leader in the flat-panel display market. However, plasma panels have gained only a small portion of their potential market because of competition from lower cost CRT products.

The expense of the display electronics, not the display itself, is the most significant cost factor in plasma displays. Because of the matrix addressing schemes used, a separate voltage driver is required for each display electrode. Therefore, a typical 512×512 pixel display requires a total of 1024 electronic drivers and connections which add considerable bulk and cost to the final product. To combat this problem, many techniques have been suggested to reduce the number of electrodes that need separate circuit drivers. The most popular methods have resulted in shift and logic panels. However, the use of these products have been limited by inherently slow panel update rates and by the expensive manufacturing processes required to fabricate the complex panels.

In a shift panel, all of the display information is typically entered along the vertical edge of the panel and then shifted across it. This method requires the same number of drivers along the vertical edge but only a small number along the horizontal edge (usually less than ten). Thus almost a two to one reduction in circuit requirements can be achieved.

The state of a particular cell within a shift panel, whether on or off, is shifted to the next adjacent cell by using either priming coupling or wall-charge coupling. The first method, priming coupling, uses priming particles produced by a nearby on cell to reduce the firing voltage at the next cell location in the shift sequence. A voltage is applied to the next cell in the sequence so that it will turn on only if it receives sufficient priming from its neighboring cell. Thus information is shifted from cell to cell across the entire display.

The priming technique relies on the presence of priming particles generated at an addressed cell location to effect one of its surrounding display pixels in such a way that allows it to be written or erased. Therefore, to use the priming technique in other than a shift mode, the proximity of the selected pixel to the selected address cell must be the controlling effect that allows it to be selected from the thousands of other display pixels receiving the same voltage signals.

The priming particles produced from a discharge are somewhat locally constrained. Put simply, electrons, ions, metastables, and photons produced in a gas-discharge can serve as agents in priming other nearby cells. The electrons, ions, and metastables are confined to affect only nearby cells because of their interactions with the electric fields and reactions with other gas-discharge phenomenon. The photons, however, are unhindered by any of the events in the gas volume and can effectively prime cells at some distance. Thus, the main drawback of priming is that other cells at a distance are caused to be "primed" in addition to the selected cells, resulting in spurious discharges - an undesirable result.

Wall-charge coupling, as its name implies, uses the actual transfer of charge from one cell to the next to accomplish the shifting. In this scheme, a cell will only fire if it receives a transfer of electrons produced when proper voltages are applied to a neighboring cell, one of whose electrodes is common to both cells. In such case, the common electrode acquires a wall charge which influences the discharge state of the next cell in line. Such types of devices are described by W. E. Coleman et al, in "Device Characteristics of the Plasma Charge Transfer Shift Display," *IEEE Transactions on Electron Devices,* Vol. ED-28, pp. 673–679, June, 1981.

A somewhat different type of shift panel is described in U.S. Pats. Nos. 4,430,601 and 4,328,489 to Peter D. T. Ngo. The shift panels disclosed therein include both display columns and "transfer" columns. When a transfer of data is described, an excitation pulse is applied to the display column and a priming pulse to the transfer column. The plasma discharge created by the excitation pulse is said to be transported to the transfer column by the action of the priming pulse causing it to switch to the ON state. Careful analysis of the Ngo structure shows, however, that the plasma discharge is actually forced to migrate to an area whose residual wall voltages are invariably more negative than the wall voltage at the display site where the plasma originated. In essence the plasma is forced to travel "uphill" and the resulting panel operation has been shown to have poor operational margins.

Shift panels suffer from a number of other disadvantages such as slow panel update rates; no random access ability; and poor yields due to the fact that one defective pixel will cause the loss of an entire line.

Another approach to reducing circuit requirements involves the use of gas-discharge logic. One such scheme is described in Schermerhorn U.S. Pat. No. 3,925,703 and by Schermerhorn and Miller in "Discharge Logic Drive Schemes", *IEEE Transactions in*

*Electron Devices,* Vol. ED-22, No. 9, pp. 669–673, Sept., 1975. In that arrangement, a display pixel is defined by the intersection of two pairs of orthogonal electrodes. The electrodes are grouped in such a way as to give each pixel four distinct inputs. A particular pixel may be erased only when all four of its inputs are selected. This gas-discharge action is functionally equivalent to a four input AND gate and employs a plasma coupling or spreading technique.

Schermerhorn's logic technique results in a rather dramatic reduction in line driver requirements. In a typical 512×512 panel, 48 lines per axis or a total of 96 lines are required. This represents an order of magnitude in savings over the normal 1024 required drivers. However, the savings in circuit costs are offset by the increase in panel manufacturing cost. Crossovers increase in number and area with increasing panel size and add expensive fabrication cost to the panel. Furthermore, the sustain signal is applied to all drive lines resulting in the sustain driver being a very high current device with a corresponding requirement that it exhibit a low impedance, a particularly difficult and expensive set of criteria to meet.

One method to reduce the electronics cost has been the development of plasma AND gates as described in copending U.S. patent application Ser. No. 462,029, assigned to the same assignee as is this application. Such AND gates can be integrated into the display panel itself, increasing its cost only slightly, while reducing electronics requirements by more than an order of magnitude. These devices have the capability of driving the capacitive load of an address electrode in a standard AC plasma panel; however, it has been found that the 20 mA sustain discharge current that is required when all the pixels along an electrode are discharging causes an undesirable voltage droop which is likely to reduce the panel operating margin excessively.

Attempts have been made to separate the sustain operation from the address circuitry. In this regard Andoh, et al. U.S. Pat. No. 4,044,349 employs 4 discharge site pixel locations and applies enhanced X and Y sustain-type pulses to one discharge site and a standard sustain signal to another site. When the addressed site discharges, particles from the discharge affect the other three discharge sites and reduce their firing levels. As a result the subsequent application of a sustain signal to the pixel site turns on the pixel site as well as the other sites. Andoh's write technique, which employs sustain-type signals, is very slow, and the use of the priming particles to influence adjacent discharge sites leads to poor operational voltage margins for the panel.

OBJECTS OF THE INVENTION

It is an object of this invention to provide a gas discharge panel with a substantially reduced number of line drivers.

It is another object of this invention to provide a gas discharge display panel which exhibits improved reliability and at least equal performance over previously known gas discharge panels.

It is still another object of this invention to provide a gas discharge panel wherein address and sustain functions are separated.

SUMMARY OF THE INVENTION

In accordance with the above objects, a gas discharge panel is provided which employs the phenomenon of plasma spreading. In this panel, plasma spreading or "coupling" is employed to couple the plasma at an addressed cell to one of a plurality of pixels to be illuminated. The spreading is controlled by assuring that the wall voltages are properly related so that the plasma electrons migrate to a region where the voltages are approximately equal to or more positive than the wall voltages where the plasma originated and deposit residual wall charges. Paired sustain electrodes are subsequently selectively energized, which, in combination with the residual wall charges cause the desired discharge site to be turned on or off.

Figure 7:
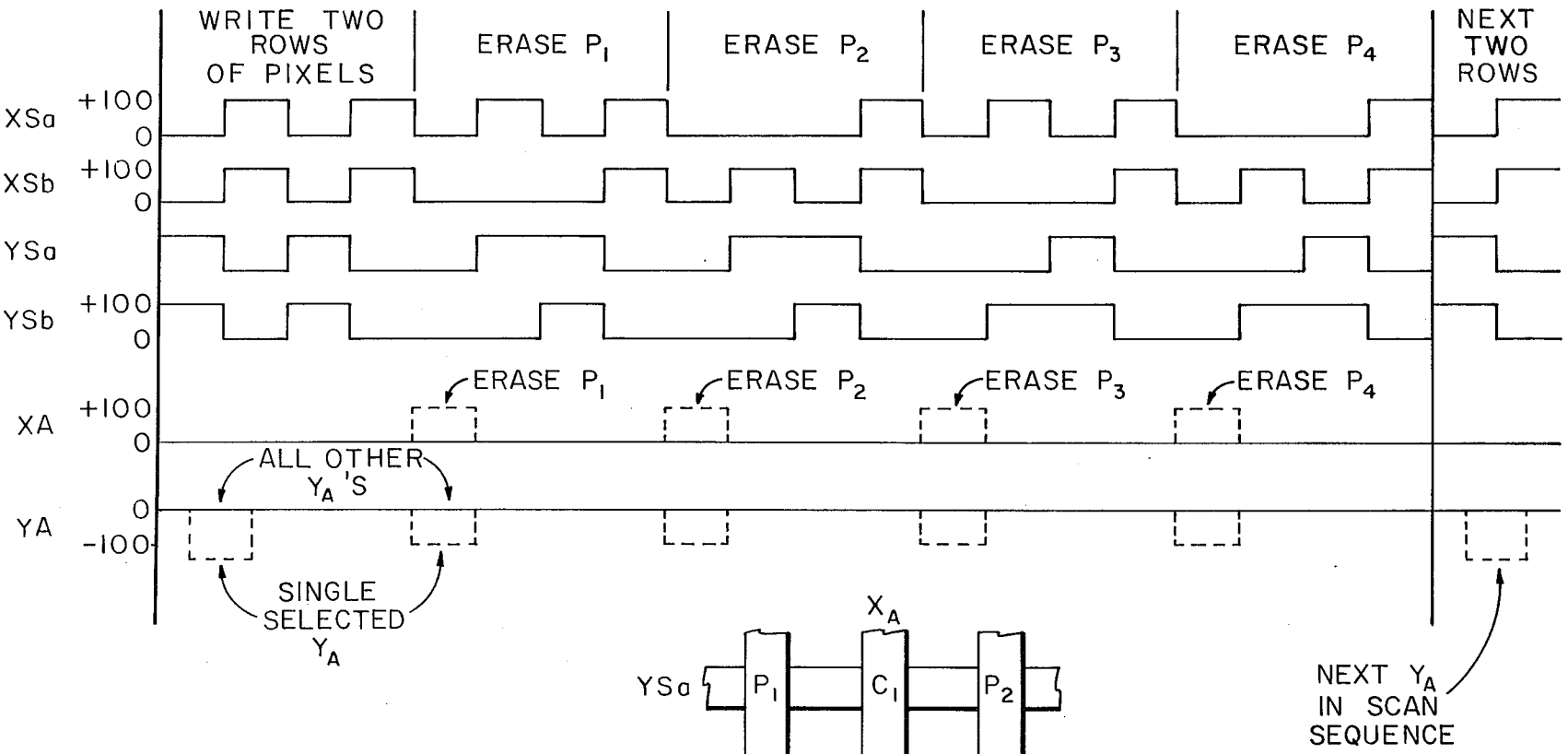
FIG. 7 are wave form diagrams useful in understanding the erase operation and the operation of the panel in a video mode.
Figure 7A:
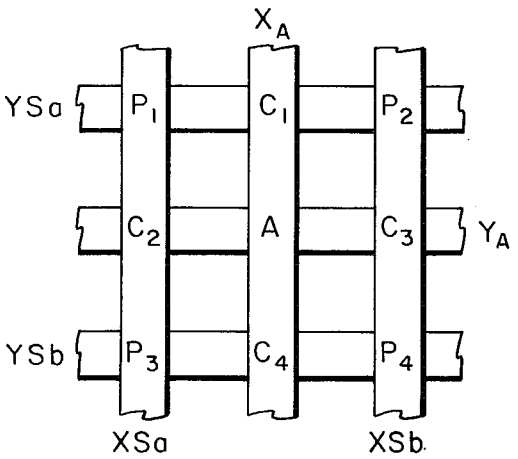

FIG. *7a* is a plan view of an electrode layout useful in understanding the waveform diagrams of FIG. 7.

Figure 8:
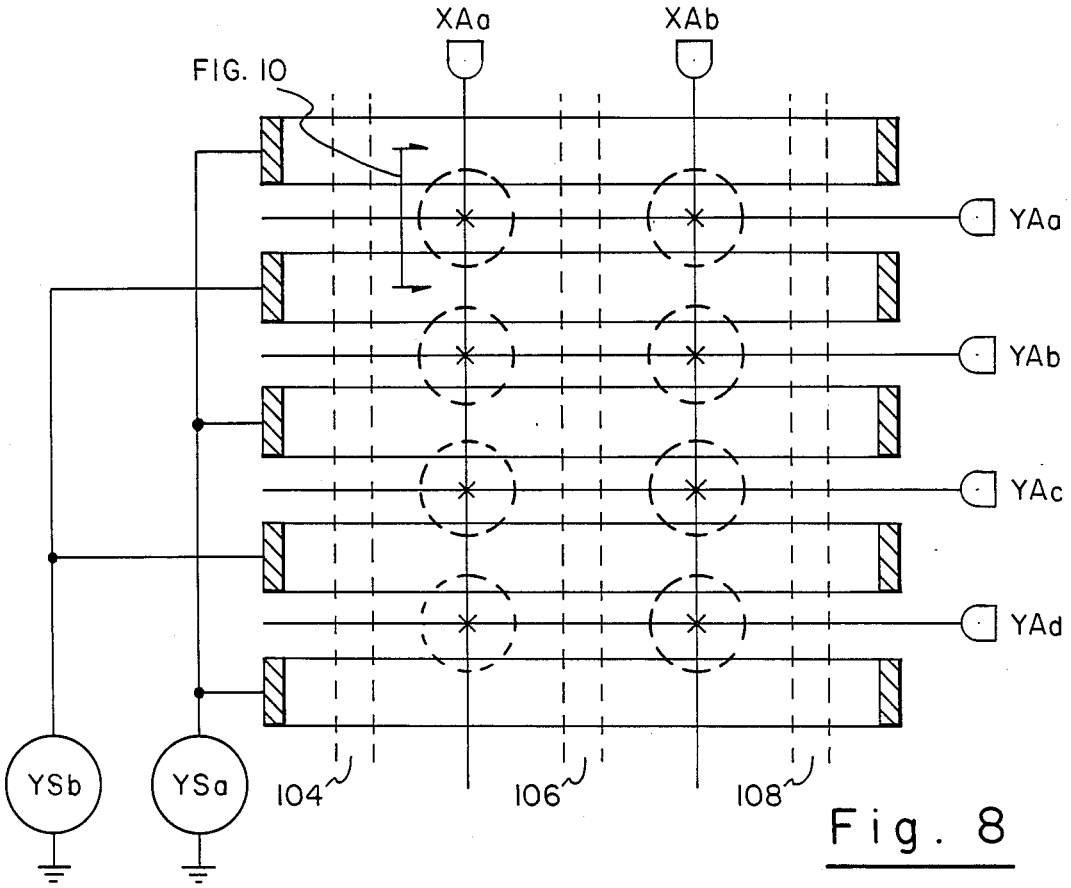

FIG. 8 is a plan view of an electrode layout of a hybrid version plasma discharge panel constructed in accordance with invention.

Figure 9:
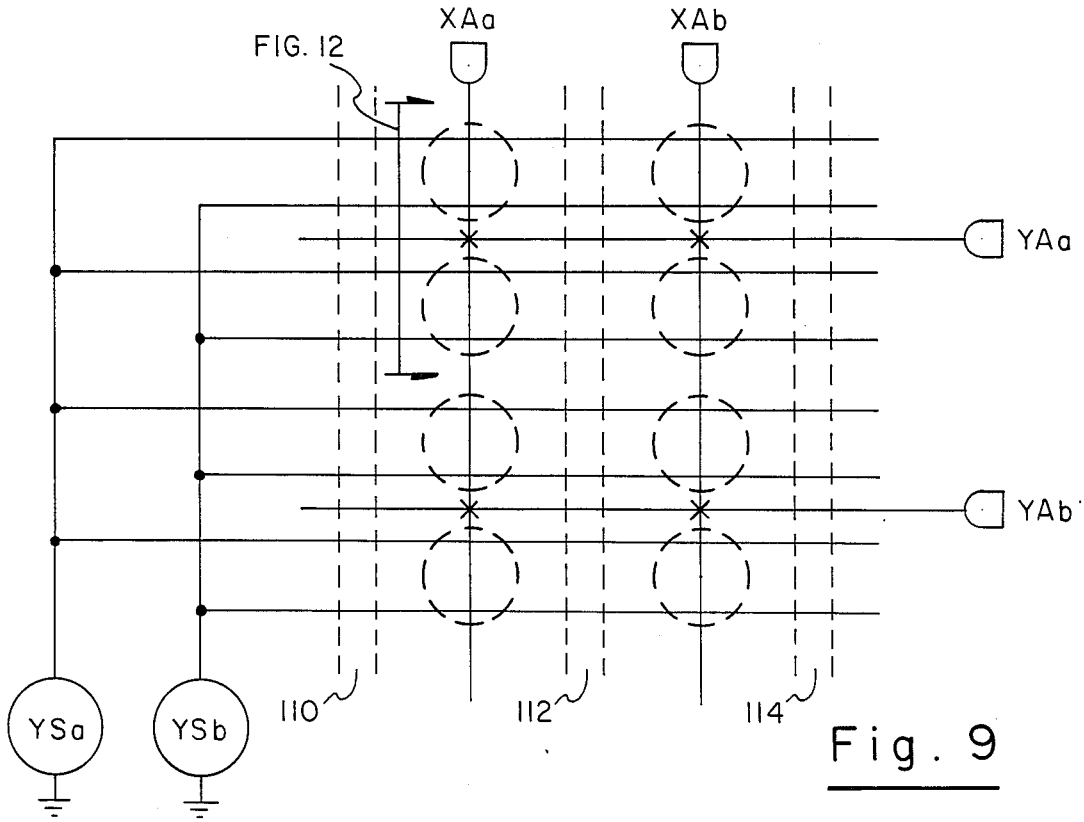

FIG. 9 is a plan view of another electrode layout of a hybrid version plasma discharge panel constructed in accordance with the invention.

Figure 10:
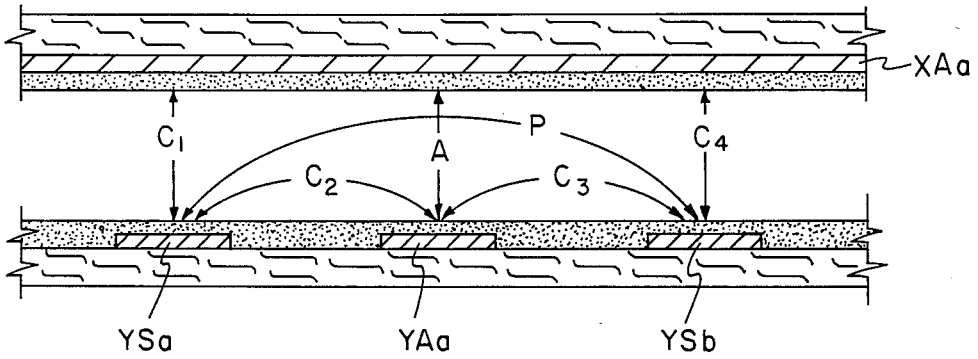

FIG. 10 is a sectional view of a pixel location of the electrode layout of FIG. 8.

Figure 11:
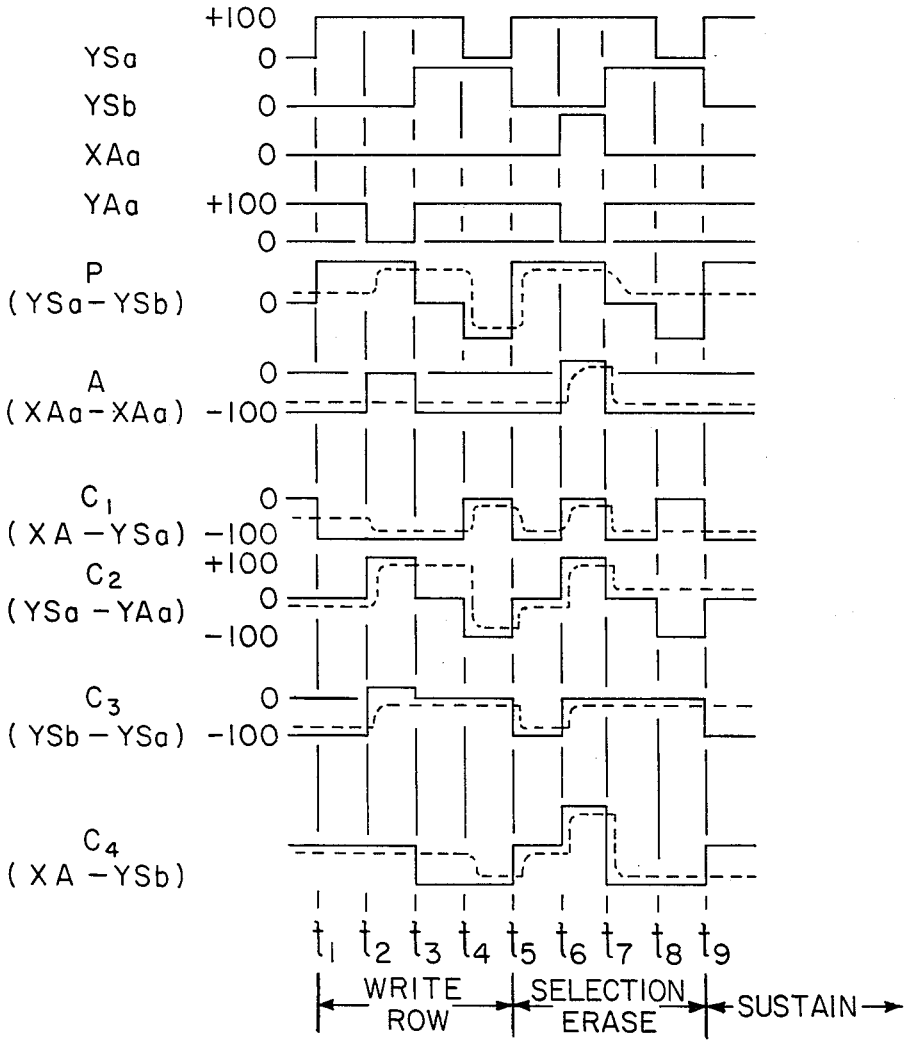

FIG. 11 are waveform diagrams useful in understanding the operation of FIG. 8.

Figure 12:
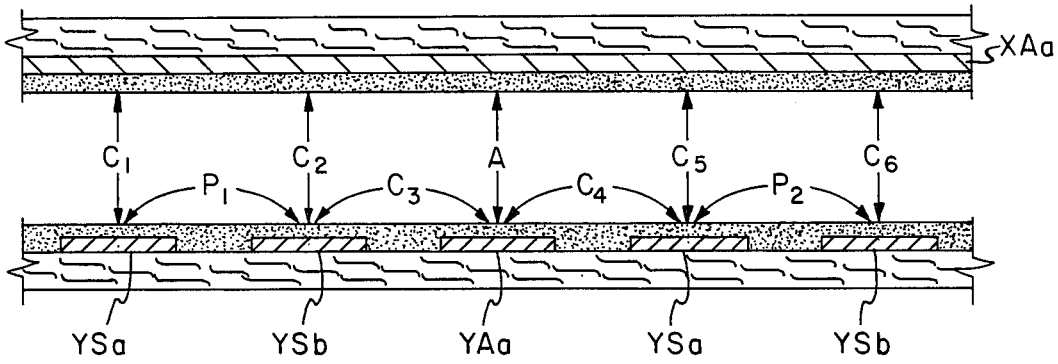

FIG. 12 is a cross-section of several pixel locations of the electrode layout shown in FIG. 9.

Figure 13:
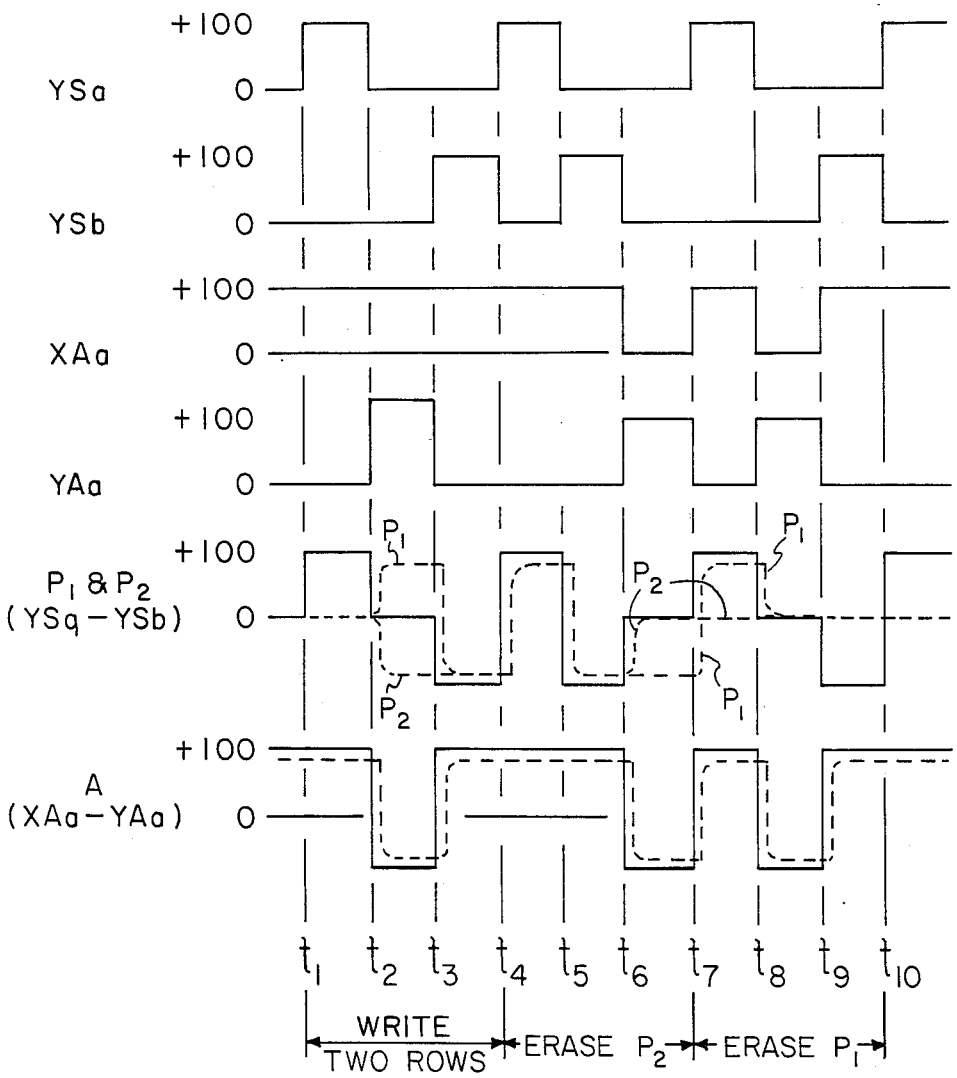

FIG. 13 are waveform diagrams useful in understanding the operation of FIG. 9.

DETAILED DESCRIPTION OF THE INVENTION

A description of the physics of operation of a plasma discharge device will enable a more complete understanding of the preferred embodiments of the invention. A plasma discharge is, in essence, a region with a high density of positive and negative charges of nearly equal proportions. In a gas-discharge panel, ions and electrons make up the charges within the plasma. After the discharge, the charged particles move to offset the electric field induced by the applied voltage. The plasma acts like a metal conductor by carrying charges in the presence of a field until the field is sufficiently offset to stop the breakdown of the gas. In other words, positive and negative charges are transferred to opposite dielectric walls by the plasma to oppose the field created by the applied voltage. The polarity of the applied voltage during the sustain sequence is usually reversed after a period of time. When this happens, a high electric field will again exist across the gas which is additive to the field created by the positive and negative charges existing on the walls from the previous discharge. In the presence of these additive electric fields, a discharge will occur causing a plasma to again develop and thus create a current path between the anode and cathode. Wall charges are again conducted to opposite ends of the gas cavity and reduce the voltage seen by the gas. While the plasma is active, it will transfer negative charges from the cathode to the anode and positive charges from the anode to the cathode. This action creates a "pulsing" light discharge, which if repeated at a high enough frequency, provides a constant pixel illumination with no perceivable flicker.

A phenomenon known as plasma spreading has been observed in the past in plasma discharge panels. Some designers have sought ways to avoid such spreading due to the "bloom" which it causes at pixel sites and the resultant degradation of the display's quality. Others (i.e. Schermerhorm in U.S. Pat. No. 3,925,703) have used it to assure that all gas cells in a multi-cell pixel are illuminated upon the application the sustain signal. Only recently has quantitative data been taken which supports the existence of plasma spreading along both the anode and cathode. The speed of plasma spread along the cathode has been measured to average about 460 meters per second, whereas along the anode it spreads at 6250 meters per second, an order of magnitude greater than the cathode plasma speed. It is believed that the difference in the plasma speed is due to the difference in the mobilities of the electrons and heavy ions. Since the highly mobile electrons are acting along the anode, the speed of the plasma in this area would be higher than in the area of the cathode where the slow ions control the discharge rate.

Figure 1:
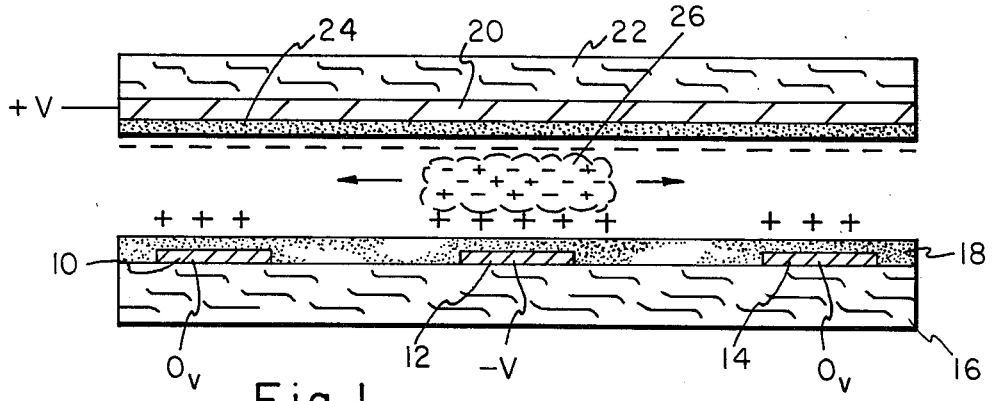
FIG. 1 is a cross-section of several pixel locations in a gas discharge panel and is used to enable a better understanding of the function of plasma coupling.

Referring now to FIG. 1, a cross section of a series of pixel sites are shown. Conductors 10, 12 and 14 are supported on glass plate 16 and are provided with a dielectric overcoat 18. Dielectric 18 is preferably glass with a magnesium oxide overcoat. Orthogonally oriented conductor 20 is supported by glass plate 22 and also is coated with glass/MgO dielectric 24. When appropriate voltages are applied across conductors 12 and 20, a plasma discharge 26 will occur and wall charges immediately begin to build up in opposition to the applied voltage. Additionally, plasma discharge 26 will preferentially spread along the portion of dielectric layer 24 which immediately overlays conductor 20 (anode) and will deposit negative charges onto the dielectric surface. If prior to discharge, preexisting wall voltages on dielectric layer 24 at pixel sites corresponding to the intersections of conductors 10 and 20, and 14 and 20 are substantially equal to or more positive than the initial wall voltage on dielectric layer 24 at the site of discharge, the plasma so created will spread nonpreferentially in both directions on dielectric layer 24 over conductor 20. On the other hand, if the wall voltage on dielectric layer 24 at an adjacent pixel site is negative with respect to the wall voltage on dielectric layer 24 at the originating discharge site, the direction of plasma electron travel is preferentially away from that adjacent pixel site. (Of course, the ions in the plasma will be attracted to the adjacent pixel site, but at a rate at least ten times slower than the electron movement). By the time the ions arrive at the adjacent pixel site, most of the discharge activity will have terminated and little wall charge effect is seen. It is the electrons movement phenomenon which is utilized throughout this invention to control pixel operations.

The aforementioned spreading of the plasma can be used to "write" pixels. If it is assumed that dielectric layer 24 at all discharge sites in FIG. 1 have zero initial wall charges, the plasma discharge spreads along conductor 20 (anode) and deposits electrons on dielectric layer 24 at all three sites. A smaller population of ions is deposited on the portions of dielectric 18 which cover conductors 10, and 14. These deposited charges leave residual wall voltages at the two outside discharge sites. If the residual wall voltages are sufficiently large, the cells will be caused to discharge upon the application of subsequently applied sustain voltage transitions. The residual wall voltage levels at the outer pixel sites have been found to be dependent substantially on the strength of the discharge at the central cell.

Figure 2:
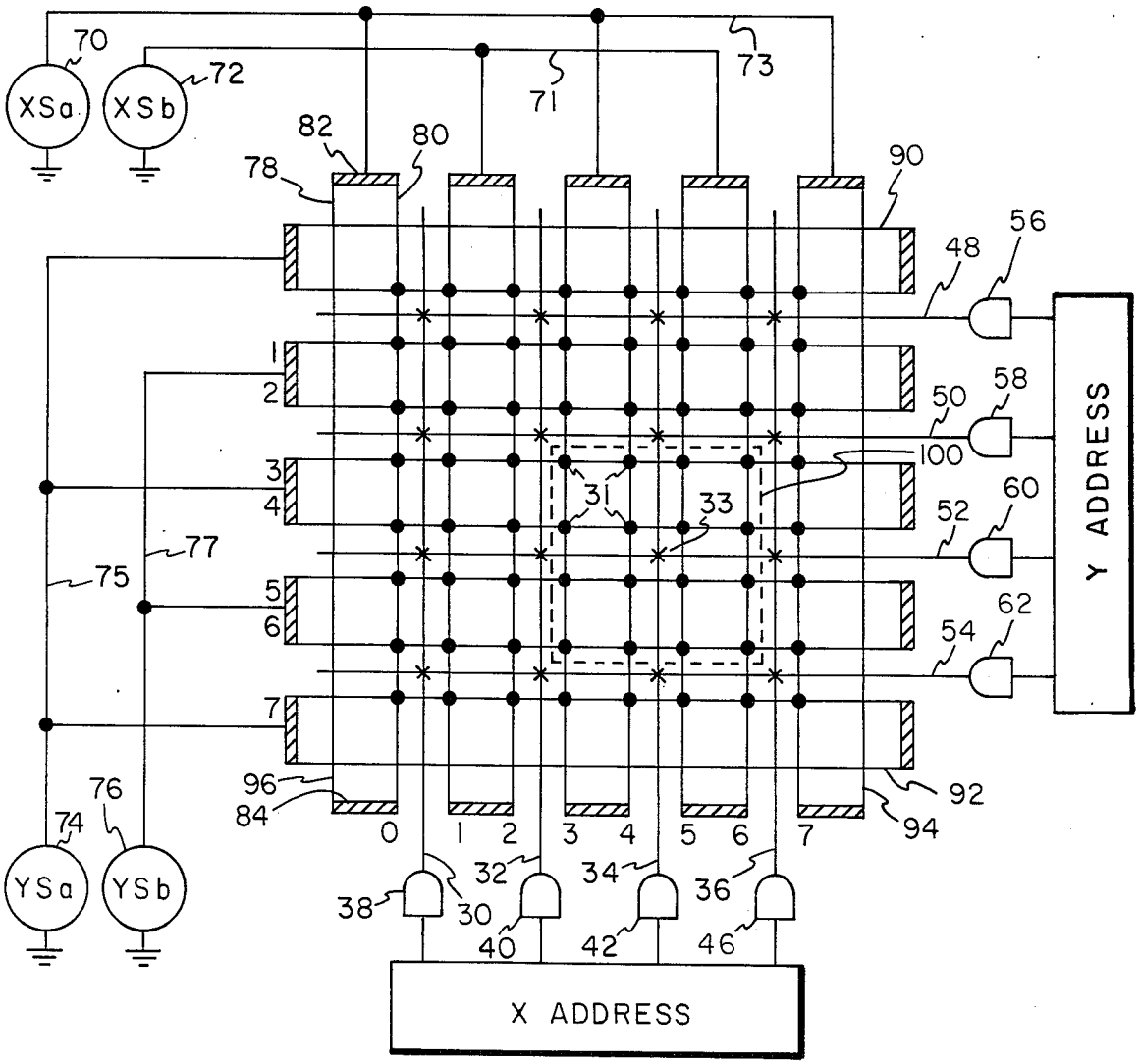
FIG. 2 is a plan view of an electrode layout in a plasma discharge panel constructed in accordance with the invention.

Referring now to FIG. 2, a plan view of a plasma panel constructed in accordance with the invention is shown. All horizontal electrodes in FIG. 2 (along with their associated electronics) reside on one substrate of the panel and are referred to as Y electrodes. All of the vertical electrodes (and their associated electronics) reside on the opposite substrate and are termed the X electrodes. In this arrangement, electrodes used for addressing are separated from those used to perform the sustaining operation. In FIG. 2 there are $8\times8$ or 64 display pixels indicated by black dots 31. Each of X address electrodes 30, 32, 34, and 36 are connected to a suitable circuit driver 38, 40, 42 and 46, respectively. Likewise, each of Y address electrodes 48, 50, 52 and 54 are connected to circuit driver 56, 58, 60 and 62, respectively. The intersections of each X and Y address electrode forms what will be referred to as an "address" cell. This address cell is used only during addressing operation and is not used as a normal display pixel. Each of the $4\times4=16$ address cells are identified by a small 33 $\times$in FIG. 2.

The X sustain signals are provided by two sustain generators 70 and 72, whereas the Y sustain signals are applied from sustain generators 74 and 76. Each successive pair of sustain electrodes (eg. 78 and 80) are shorted together by shorting bars 82 and 84 at either end thereof, thus forming what shall be referred to hereinafter as a sustain electrode pair. Alternating sustain electrode pairs on a given substrate are bussed together by a sustain bus resulting in two sustain busses on each substrate. On the X substrate, busses 71 and 73 are respectively connected to sustain generators 70 and 72 and on the Y substrate, buses 75 and 77 are connected to sustain generators 74 and 76. It should be noted that this arrangement results in only two connections along the X sustain edge of the panel and two connections along the Y sustain edge. With this sustain arrangement, four circuits are needed to completely sustain the panel. This remains true regardless of whether the panel is $8\times8$ or $512\times512$ pixels in size.

Also shown in FIG. 2 are edge field electrodes 90, 92, 94 and 96. These are sustain electrodes which reside along the four edges of the addressable area of the panel. The pixels at these locations are not addressable. These extra sustain electrodes are required in order that the outer-most addressable pixels see a similar field as the other pixels in the panel. Also, these extra sustain electrodes complete the loop of the sustain electrode pairs along the border of the display.

Figure 3:
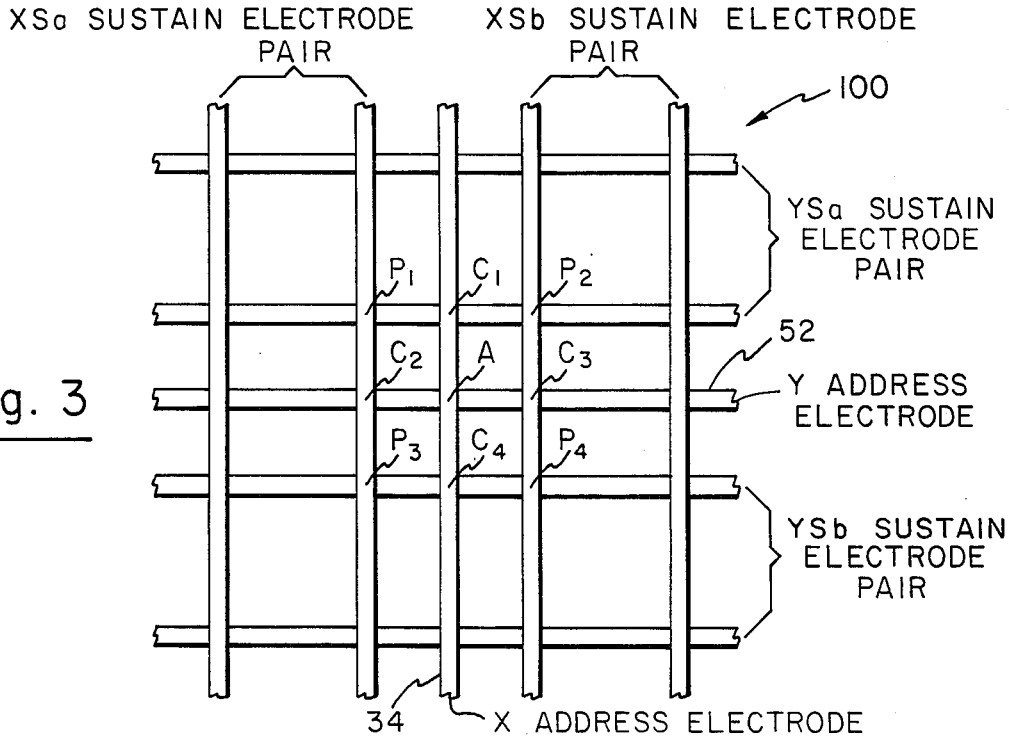
FIG. 3 is an expanded view of a portion of the electrode arrangement in FIG. 2.

The area encircled by the dashed line and denoted as 100 in FIG. 2 is shown in detail in FIG. 3. Note, that as in FIG. 2, all X-level electrodes are supported by one substrate, and all Y electrodes are supported by the other substrate with an ionizable gas disposed therebetween.

Address cell A resides at the center of the FIG. 3. The four nearest neighboring display pixels to address cell A are labeled as P1, P2, P3, and P4. Four additional discharge locations act as "coupling" cells with the two vertical coupling cells being labeled C1 and C4, and the horizontal coupling cells denoted as C2 and C3. Note that each of the four display pixels, P1–P4, are controlled by a different combination of X and Y sustainer conductors. Pixel P1 is defined by the intersection of the XSa/YSa sustain electrodes, whereas pixel P2 is defined by the intersection of the XSb/YSa electrodes, etc.

Because of the bussing structure of the sustain electrodes, the voltage applied to pixel P1 is also applied to one quarter of all of the display pixels on the panel. The same is true for pixels P2–P4. Thus, a single display pixel cannot be individually selected for write and erase operations by using sustain electrodes to control the pixels as is the case in the standard matrix addressable plasma panels. For that reason, the X and Y address electrodes must be used to access them. In summary therefore, each address cell is surrounded by eight discharge sites wherein four (P1–P4) are used as actual pixel display sites, and four (C1–C4) are used to accomplish the selective control of the display pixel sites.

Prior to discussing the operation of an exemplary address site, the overall addressing technique for the display panel will be briefly discussed. A video addressing technique was employed since it is the most common interface found in current display products. Video data is entered along the column electrodes for one horizontal row at a time. The top row of the panel is addressed first. After a row is completely addressed, a horizontal synch signal signifies that the next row in the panel is to be addressed. This row by row scanning continues until the bottom row in the panel is addressed at which time a vertical synch signal indicates the start of a new frame and the scanning sequence begins again at the top row of the panel. In applying this addressing technique to the panel shown in FIG. 2, initially all display pixels in the two rows on either side of a Y address electrode are written. Those display pixels in the same two rows that need to be in the off state are subsequently erased. The video scanning sequence then continues by writing the next two rows of display pixels, etc. This method requires two distinct types of cycles. The first being a "Write Two Rows" cycle, where the two rows of display pixels that run parallel to a selected Y address electrode are turned on; and the second being a selective erase cycle where the display pixels specified as off in the video bit stream are erased. Each of the specific cycles described above will be discussed herein below separately.

Figure 4:
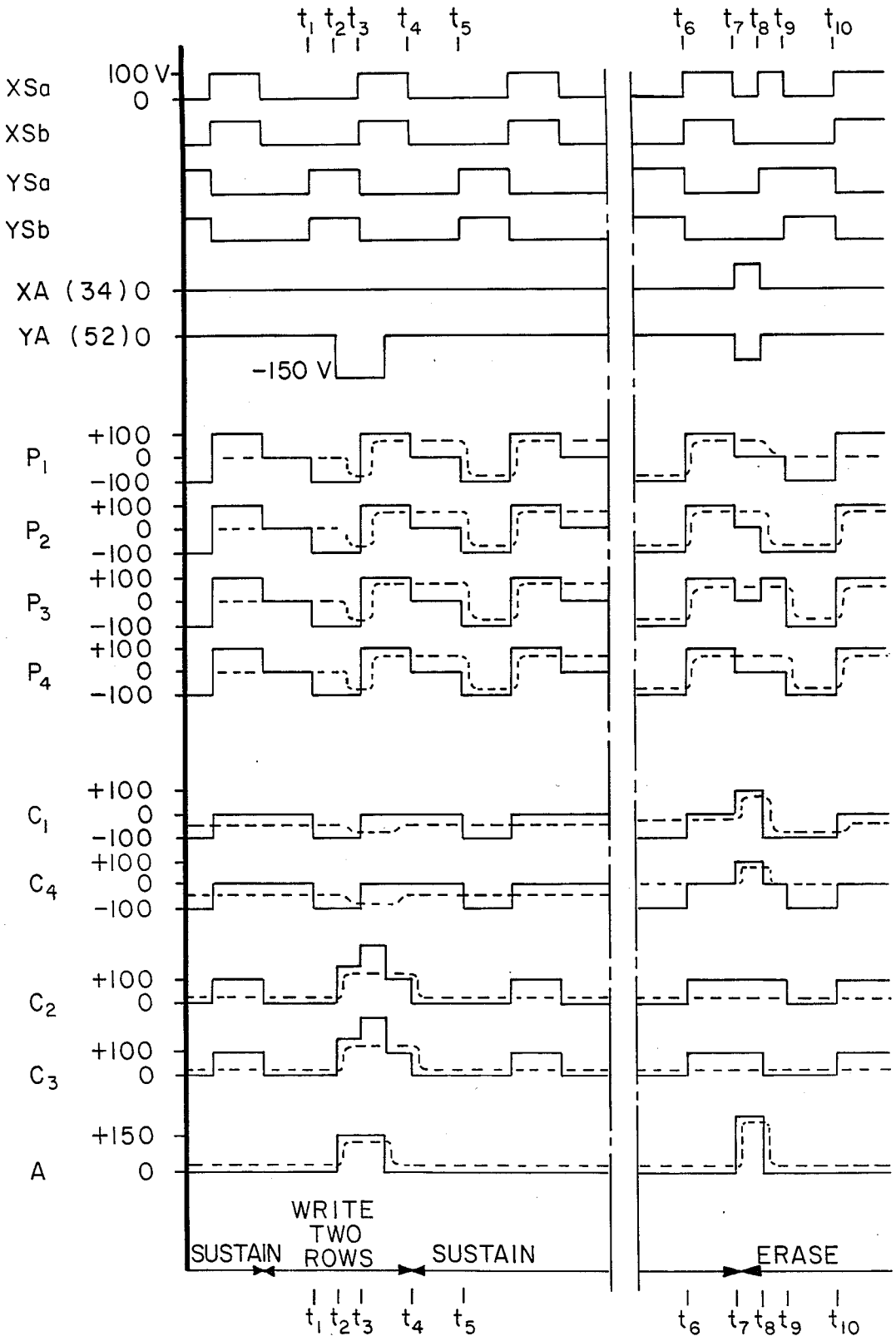
FIG. 4 are waveform diagrams useful in understanding the operation of FIG. 2.
Figure 5:
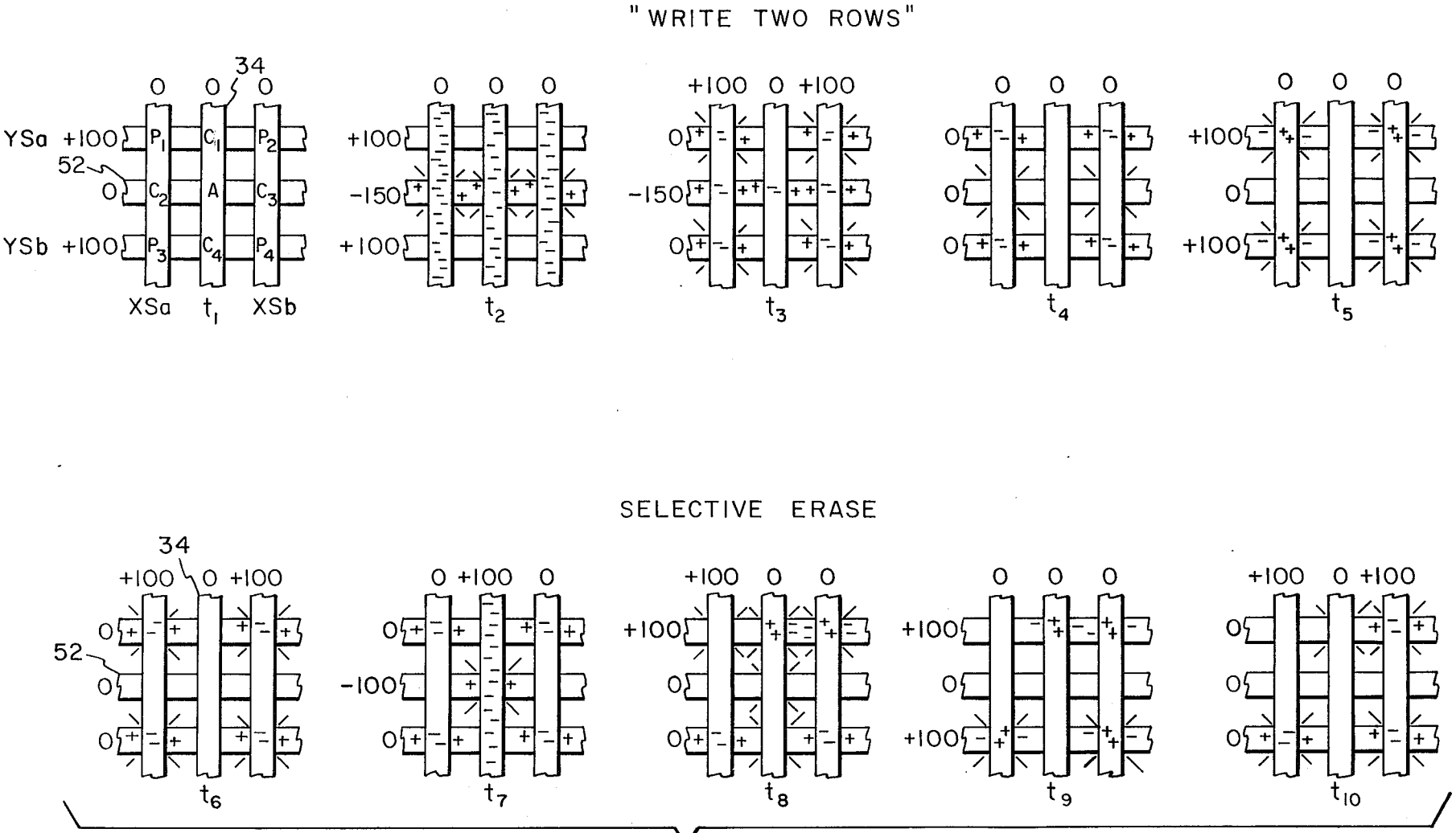
FIG. 5 shows the charge state at a group of pixel sites at various times during the operation of the invention.

Referring now to the waveforms shown in FIG. 4 in conjunction with FIG. 5, the "Write Two Rows" cycle will be described. In FIG. 4, the applied voltages to each of the sustain and address lines are indicated; the net applied voltages experienced by each of pixels P1–P4, coupling cells C1–C4 and the address cell A; and their respective wall voltages (drawn dashed and inverted-as is conventional). The diagrams in FIG. 5 show the respective cell states after the discharge caused by the applied voltage transitions at the various times $T_1$–$T_{10}$. The plus signs represent positive charges and minus signs negative charges. The charges have been placed on either the top or the bottom electrodes to reflect on which side of the cell they reside after the discharge activity has been completed at the given time. If four diagonal lines surround the cell, it indicates that the cell discharges at the time indicated.

During the "Write Two Rows" cycle, all four sustain generators XSa, XSb, YSa, and YSb and all of the X address electrodes function as they would in a normal sustain cycle. A large negative pulse is placed on Y address electrode 52 at time T2 while positive sustain pulses are present on sustain lines YSa and YSb. The negative pulse causes a large discharge to occur in address cell "A" and horizontal coupling cells C2 and C3. While the address voltage is shown at −150 volts, that is merely for explanatory purposes and can be varied in accordance with the design features of the particular panel. The other voltage levels indicated in FIG. 4 are also exemplary and for descriptive purposes only.

As aforesaid, the application of the negative going pulse at T2 on Y address electrode 52 causes discharges to occur in both the A address cell as well as coupling cells C2 and C3. Note that during the application of the address pulse on Y address electrode 52, both XSa and XSb electrodes are approximately 150 volts more positive for the period between $T_2$ and $T_3$. As a result, the electrons from the plasmas which are created by the discharges at coupling cells C2 and C3 and address cell A travel along the vertical electrodes into the pixel sites P1–P4 on either side of the discharging cells (See FIG. 5 at time T2).

At time T3, both XSa and XSb sustain electrodes have positive pulses applied thereto and, in conjunction with the prestored wall voltages, pixels P1–P4 are caused to discharge and to emit a light pulse. (It should be remembered that only a pulse of light is given off at each wall voltage excursion).

Upon the next negative going excursion of sustain electrodes XSa and XSb, pixels P1–P4 do not discharge since there is insufficient voltage drop across the cells. Subsequently, the positive going excursion on the YSa and YSb sustain lines cause pixels P1–P4 to discharge. At time T4, the negative going excursion of the sustain lines resets the wall charges in the horizontal coupling cells C2 and C3 to their original state.

In sum, during the Write Two Rows cycle, horizontal coupling cells C2 and C3 initiate discharges which affect display pixels P1–P4. The associated X dimension sustain electrodes act as anodes during the $C_2$, $C_3$ discharges thereby allowing the plasma generated by the discharging coupling cells to reach into the display pixels and to deposit electrons beneath the sustain electrodes. The deposited electrons reduce the wall voltages from near 0 to some negative value which, upon future sustain cycles, cause display pixels P1–P4 to discharge.

While FIG. 4 shows one set of write two rows waveforms, other cases of write two rows have been found to work properly. Those cases consist of two possible polarities of the $Y_A$ pulse (both positive and negative) in combination with the two possible polarities of the X and Y sustain pulses. All four cases work with excellent voltage margins even though each uses a different physical addressing mechanism.

Once both rows of pixels have been written, one or more sustain cycles generally will follow to stabilize the charge states within the panel. Then, an erase cycle is commenced which erases selected pixels to provide the desired information content for each display line. The selective erase of a pixel is a two step process and may be understood by referring to FIG. 6. In the first step, cell A is addressed by simultaneous application of positive and negative pulses to the X and Y address lines respectively. This causes a plasma to be created at address cell A which spreads along the X address line electrode (anode). The plasma reaches into vertical coupling cells C1 and C4, causing electrons to be deposited on their dielectric walls beneath the X address line electrode. In the second step of the erase cycle, vertical coupling cell C1 is discharged and the plasma so generated spreads along the YSa electrode reaching into display pixels P1 and P2. The voltages applied to the XSa and YSa sustain electrodes at this time are so phased that pixel P1 is erased and P2 left unaffected.

The detailed operation of the erase cycle will now be described with reference to both FIG. 4 and FIG. 5. In the first step of the erase sequence, address cell A must be used to influence the vertical coupling cells C1 and C4. For the purpose of example, consider erasing pixel P1 (upper left-hand pixel). As shown in FIG. 4, between times T6 and T7, the sustain voltages applied to XSa and XSb cause each of pixels P1–P4 to discharge in the normal sustain mode (they having already been written into the "on" state during a previous Write Two Rows cycle). At time T7, a positive going pulse is induced on X address electrode 34 and a negative going select pulse is induced on Y address electrode 52. This results in a sizable discharge occurring at address cell A. In addition, since the X address electrode 34 acts as an anode during the discharge of address cell A, the plasma spreads along beneath it into the C1 and C4 coupling cells. As a result, a negative charge is deposited therein from the plasma. This can be seen in FIG. 4 on the wall voltage diagrams for both coupling cells C1 and C4 at T7.

The second step of the erase sequence starts at time T8. At such time, the C1 coupling cell whose X address electrode dielectric was negatively charged in the first step of the erase operation is used to erase pixel P1. At time T8, the voltages on both sustain lines XSa and YSa rise to approximately 100 volts. Due to the previously stored wall charges at $C_1$ which are additive to the applied potential on sustain line YSa, cell C1 is caused to discharge. (Note that C1 would not discharge at this time if its wall voltage had not been raised at time T7). Also the raised voltage on the YSa electrode causes it to act as an anode during C1's discharge and allows the plasma created thereby to be coupled into the P1 pixel site. The electrons thus deposited by the spreading plasma during time T8 neutralize the previously stored charges at P1 thereby causing P1 to be erased. This is indicated in FIG. 4 by the slanted portion of the wall charge voltage on the P1 line after time T8.

During this erase cycle, it is vital that the other display pixels not be affected. While P1 is being erased, the plasma generated at coupling cell C1 will reach both into P1 and P2. Recall that P2 was turned on during the Write Two Rows cycle. When, however, the raised voltage is applied to the YSa electrode at time T8, that potential, added to the prestored wall charge causes P2 to discharge. This is a normal sustain discharge which keeps pixel $P_2$ in the on state and prevents the $C_1$ discharge from affecting it. It should be noted that if P2 was in the off state, the wall voltage potential under the YSa electrode at pixel P1 would much higher than the YSa wall voltage at P2. Thus the plasma created by the discharge of C1 would reach out and discharge pixel P1 first, exhausting itself before it could transfer negative charge to pixel P2. Thus, P2 would remain off.

To insure that pixels P3 and P4 are not affected, coupling cell C4 must not discharge at time T8. This is assured by controlling sustain electrode YSb differently from sustain electrode YSa. Note that there is no positive going transition at time T8 on YSb thereby preventing any discharge at coupling cell C4. On the other hand, when the X and Y address line voltages fall, there is a substantial voltage change impressed across address cell A which creates a discharge. In this instance, as contrasted to prior instances, it is the ions which migrate (slowly) towards cell C4 and act to neutralize the prestored wall charges therein. This sets up C4 for a subsequent address cycle.

At time T9, the voltage on sustain line XSa falls to 0. One hundred volt levels are present on sustain lines YSa and YSb. As a result, a sustain discharge occurs in pixels P3 and P4 (remembering that they were previously in the on state). These transitions occur due to the combined voltage transitions on sustain lines XSa and YSb. At time T10, coupling cell C1 is discharged by the application of the negative going potential on sustain electrode YSa. That negative going potential when added to the wall charges stored therein effects the discharge of cell C1 thereby resetting it for the next address cycle.

To employ the plasma coupling technique in a video addressing mode, it is preferred to break up the erase cycle into four distinct subcycles (See FIG. 7). The first erase subcycle is used to erase pixels on the top row that are controlled by the XSa sustain electrode. The second erase subcycle is used to erase any of the display pixels along the top row controlled by the XSb sustain electrode. The third and fourth erase subcycles are used to erase the display pixels on the XSa and XSb sustain electrodes along the bottom row. Referring now to FIG. 7, the waveforms required for the subcycle erase operation are shown. The dashed line on the Xa address line shows the voltage as applied to the X address electrode if the pixel corresponding to the particular erase cycle is to be erased. The dashed line on the Ya address line shows the voltage applied to the single Y address electrode that runs between the two horizontal rows of pixel electrodes being addressed. The solid line along the Ya address indicates that all other Ya electrodes are not perturbed.

In the erase P1 subcycle, the XSa and YSa address lines are both at a high level just after the fall of the Xa erase pulse. This erases any pixel that is at the XSa/YSa intersection providing a discharge first occurred at its address cell. In the erase P2 subcycle, XSb and YSa sustain lines are both at a high level. Any "on" pixel residing at the intersection of the XSb/YSa sustain electrodes will be erased providing that its address cell was selected at the beginning of the erase cycle. Succeeding cycles work in a similar fashion. Note that the YSa address line is selected in the first two cycles when the pixels on the top electrodes are being erased, while the YSb electrode is selected during the last two cycles when the bottom row of pixels are being erased. It will also be noted that each of the erase cycles is actually composed of an erase and a sustain. A single sustain discharge is needed after the erase cycle to complete the subcycle.

The advantages of the above-described address and sustain technique are numerous. Most notable is the two-to-one reduction in the address electrodes. Thus, only half the number of circuit drivers are required to address a panel based on the plasma coupling concept.

In addition, since the sustain and address circuits have been separated, the load seen by the address circuit is substantially lessened because the sustain load is relegated to those sustain drivers. Because of this separation of function, high impedance address drivers become usable. (essentially are cheaper than low impedance circuits.) Furthermore, the gas discharge gate structures shown in copending application Ser. No. 462,029, (which are inherently, high impedance) may be constructed directly on the plasma panel structure further reducing the requirement for off-panel driver circuitry.

A further advantage of the above-described design is the reduction in the number of potentially defective panels during manufacturing. It can be demonstrated that the electrode yield is increased by a factor of two over the standard electrode design. This is due to the fact that panel yield is most often hurt by electrode breaks. The key factor that contributes to the increased yield are the sustainer electrode design and the decreased number of address electrodes. In essence, each sustain electrode is doubled so that a break on one does not necessarily disconnect pixels below the break from the drive circuitry. The pixels below the break are still connected to the line drivers via the shorting bar that connects to the neighboring sustain electrode. This alternate conduction path allows all pixels on the broken electrodes to remain fully operational.

A further feature of this development is that there are less sustain bus crossovers than in previous designs. In addition, the peak currents required from the sustain drivers are lessened due to their duplication.

A plasma panel constructed in accordance with the above teaching has been successfully operated. Its specifications are as follows:

Dielectric Glass thickness: 25 um
Dielectric Glass Dielectric Constant: 15
MgO Overcoat Thickness: 150 nm
Gas Gap Distance Between Substrates: 100 um
Gas Mixture: 400 torr Ne+0.1% Ar
Electrode Width: 75 um
Center to Center Spacing of Pixels: 400 um
Center to Center Spacing of Address and Sustain Electrodes: 200 um

WAVEFORM TIMING

Sustain Pulse Width: 6 us or longer
$Y_A$ Write Pulse Width: 10 us or longer
Erase Pulse Width: 5 us or longer

WAVEFORM VOLTAGE AMPLITUDES

Sustain Voltage: 89 to 98 volts
$Y_A$ Write Pulse: −140 to −260 Volts
$X_A$ and $Y_A$ Erase Pulses: 80 to 140 Volts The number of connections to the panel can be further reduced by employing a gas discharge serial-to-parallel shift register to load the gas discharge X and Y address gates. Such gas discharge shift registers are compatible with the technology of the herein-described plasma coupling structures. Such a similar shift register operates in principle similarly to that shown in the Coleman, et al. article cited hereinabove. The parallel output from the shift register would be applied directly to the X and Y address gates.

When gas discharge AND gates are connected to the address electrodes of the circuit of FIG. 2 to reduce the number of address drivers, the input electrodes of these AND gates are normally connected in a mutiplexing arrangement that allows for a reduced number of drivers. For instance, to drive 256 address electrodes, 256 AND gates would be used and the AND gate inputs would be bussed in two groups of 16, ($16\times16=256$) so that only $16+16=32$ drivers are required (See FIG. 1 of copending U.S. patent application Ser. No. 462,029). This number can be reduced even further by using a gas discharge shift register to drive the inputs of the AND gates. This approach is especially attractive for driving the Y axis AND gates for a display operating in video mode. Such operation requires that only one Y address electrode (horizontal) be selected at any one time. The gas discharge shift register for the Y axis needs to shift only one bit along the Y axis to select the single AND gate that addresses the single Y address electrode. Since suitable gas discharge shift registers can be designed with as few as 4 electrode inputs, such a technique offers a considerable advantage over other techniques such as the one discussed above requiring 32 drivers. In video mode, only these 4 inputs would need be driven for a display of any number of Y address electrodes. Such a gas discharge shift register could also be used for the X axis address drivers, however, the data input to this X shift register would be more complicated, reflecting the video input to the display.

There are a number of ways that a gas discharge shift register could be designed to drive the AND gates. Such shift register devices have been developed for display purposes and are reviewed in the paper by Coleman, et al. referred to above. The output of the shift register can be in the form of a voltage on an electrode that is connected to the input electrode of the gas discharge AND gate. Alternatively, the output of the shift register can be a plasma in the shift register that couples to the gas discharge AND gate to deposit wall charges that will cause the AND gate to discharge.

The gas discharge AND gates can also act as storage registers to hold binary information by means of the wall charges in the AND gate. If these wall charges are present and the appropriate pulses are applied to the electrodes of the AND gate, then the gate will generate an output pulse that can be used to drive a plasma panel address electrode. The gas discharge shift register having video or other data can be used to transfer data to the storage register in the AND gate and then the AND gate can be pulsed at a later time as required by the addressing requirements of the plasma display. These independent AND gate load and pulse output times facilitate the rapid distribution of data to the AND gates at a time when the plasma panel does not require address pulses. This yields a considerable time savings that allows faster display scanning and data transfer rates.

The invention disclosed here has been discussed in terms of the conventional two substrate display shown in FIG. 1. It is equally applicable to a single substrate display wherein both sets of orthogonal electrodes are placed on the same substrate. Such a plasma display is constructed by first depositing a set of parallel electrodes on the substrate glass. For purposes of illustration these will be designated the X electrodes. A dielectric layer is then deposited over the substrate which covers the X electrodes. Next a set of parallel Y electrodes is deposited on the dielectric layer and are positioned to be orthogonal to the parallel X electrodes. Next a dielectric layer is deposited over the Y electrodes. A suitable gas is then placed in contact with this dielectric layer so that a gas discharge can be ignited by means of the fringing fields that extend into the gas from the X and Y electrodes. The properties of this single substrate plasma display are discussed in a paper entitled "A Planar Single Substrate AC Plasma Display" written by G. W. Dick and M. R. Biazzo, which appears in *IEEE Transactions on Electron Devices,* Vol. ED-23, pp. 429–437, April, 1976.

Figure 6:
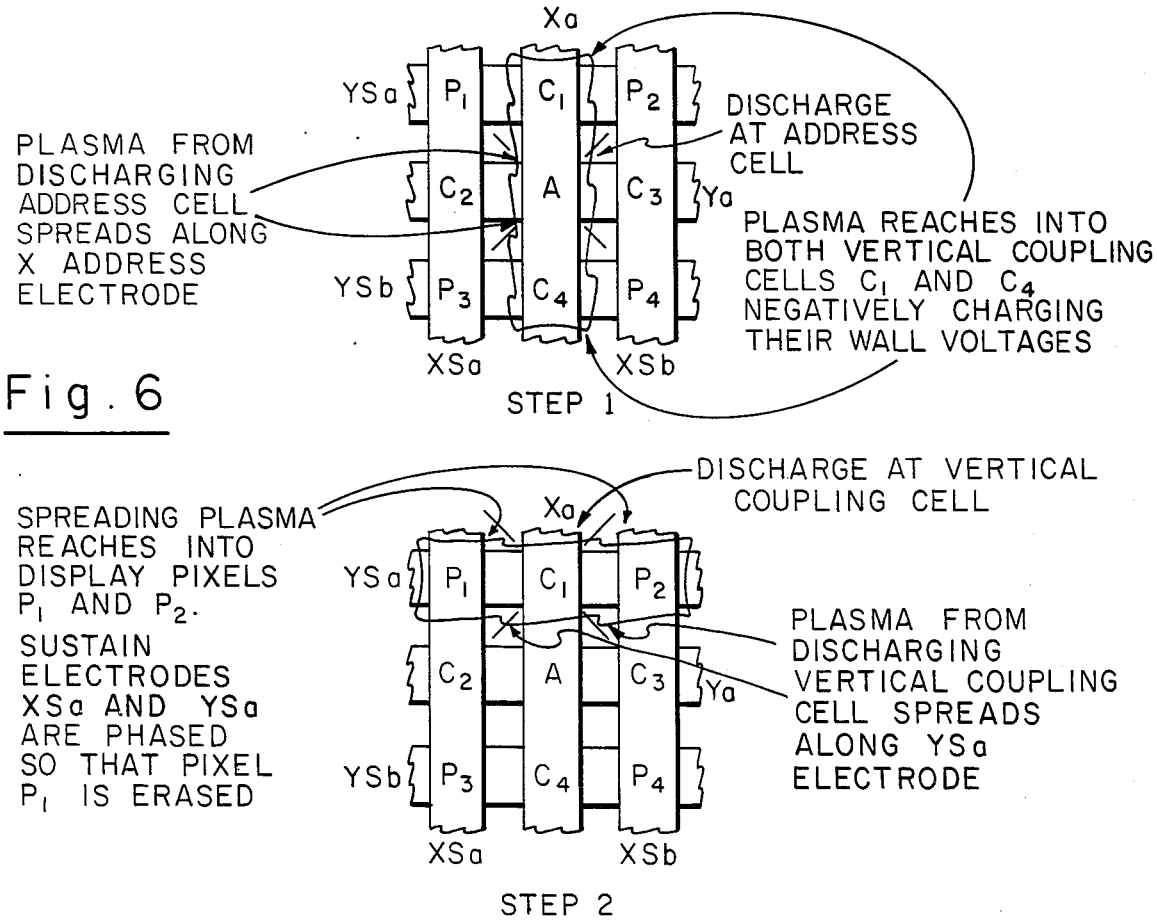
FIG. 6 is an expanded view of a pixel site during the erase operation.

An alternate form of selective erase may be employed in comparison to that shown in FIG. 6. Recall that the selective erase technique is a two step process whereby the pixel $P_1$ is addressed by means of discharges in coupling cell $C_1$ and address cell A. It is also possible to address pixel $P_1$ through coupling cell $C_2$. In this case during step 1 the $Y_A$ electrode would be made the anode so that the plasma would spread along the horizontal direction to horizontal coupling cells $C_2$ and $C_3$. Then in step 2, one of the horizontal coupling cells $C_2$ or $C_3$ would be discharged to address one of the pixels.

The waveforms to accomplish this are virtually the same as shown in FIG. 4 with the exception that all of the applied X and Y waveforms are exchanged. Also appropriate modifications are made in the sequencing of the sustain pulses diring the four erase periods shown in FIG. 7 so that the erase sequence of $P_1$, $P_2$, $P_3$, and $P_4$ is preserved. It is desirable to preserve this erase sequence so to accommodate the video input data stream. This sequence has an advantage that the discharge sequence of the coupling cells is staggered. For example, when erasing through the horizontal coupling cells, the coupling cell firing sequence for the four erase cycles would be $C_2$, $C_3$, $C_2$, $C_3$. The technique shown in FIG. 7 that uses the vertical coupling cells, has the firing sequence $C_1$, $C_1$, $C_4$, $C_4$. By staggering the sequence of the horizontal coupling cells, successive discharges of a cell during the erase cycle are avoided and the coupling cell's wall voltage is allowed to come to an equilibrium value that will set up the coupling cell for the proper discharge amplitude.

A further reduction in the number of address circuit drivers can be achieved with an electrode connection technique that uses more sustain generators. For instance, the technique shown in FIG. 2 shows that 8 rows can be addressed with 4 address drivers 56,58,60 and 62 by utilizing two Y sustain drivers 74 and 76. It is possible to use these 4 address drivers to address 16 rows if the number of Y sustain drivers is increased to 4. The modifications to the circuit of FIG. 2 would involve the replication of the illustrated sustain lines for Y addresses 8 to 15 and the connection of two additional Y sustain drivers in much the same manner as Y sustain drivers 74 and 76 are connected to their respective sustain pairs. Each of the address driver lines would be similarly positioned between sustain line pairs. Address driver 56 would be connected, in addition to electrode 48, to the electrode between Y address sustain lines 8 and 9; address driver 58 to the electrode between sustain lines 10 and 11; etc.

The pixel that is to be addressed would be determined by which of the four sustain generators is selected during the address period. For example, to address the row electrode with Y adress=9, address driver 56 is pulsed in conjunction with proper phasing of the sustain driver connected to the proper sustain electrode pair. The other rows associated with address driver 56 (Y address rows 0, 1 and 8) would not be influenced because their respective sustainers would be phased differently. This technique could further be extended for additional reduction in the number of address drivers by the addition of more sustain generators.

This alternative technique connects two address electrodes together along the right hand edge of the panel. By also connecting each connected address electrode pair along the left hand edge of the panel, additional redundancy could be achieved to protect against electrode breakage. Since each address electrode is connected at both ends, a single break in one address electrode of the address electrode pair will not cause any address failures because of the alternate conduction path. This technique would allow for very significant increase in panel yield beyond that already achieved by pairing the sustain electrodes. Of course, the cost of this modification is seen in a number of added cross-overs.

The above example discusses address driver reduction for the Y axis. Of course, similar techniques are applicable to the X axis.

The examples presented have assumed that the plasma display will be addressed in the video mode which is commonly used for computer and television displays. It is also desirable for displays to be addressed in the random access mode of operation. In such a mode the display receives an address which can be used to turn a selected pixel or pixels either on or off. The techniques presented here could readily be applied to a display operating in random access mode.

Referring now to FIGS. 8 and 10, a hybrid design for an AC plasma display panel is shown which employs concepts used in both single and double substrate panel structures. In this structure, all dimension electrodes are on the upper substrate and all Y dimension electrodes are on the lower substrate. The sustain generators are applied only to the Y axis of the display (lower substrate). The X electrodes are used only for addressing and no sustain signals are applied thereto. One advantage of this type of structure is that only the XA electrode is present on the upper glass substrate of the panel and allows a greater amount of light to be emitted than other panel constructions. One disadvantage of this design is that the plasma discharge tends to spread along the length of the Y electrodes and to make the display useful, physical barriers 104, 106, and 108 are emplaced between each row of pixel locations. These barriers can take the form of solid ribs placed in the glass gap between the substrates.

In FIG. 10, the cross-sectional view of a single pixel region of the hybrid display of FIG. 8 is shown. In this case, the actual display pixel discharge occurs between the YSa, YSb electrodes. Coupling cells $C_1$, $C_2$, $C_3$, and $C_4$ exist as shown. The address cell A is shown between the XAa and YAa electrodes.

The waveforms for the operation of the display of FIGS. 8 and 10 in a video mode are shown in FIG. 11. Initially, there occurs a "WRITE ROW" cycle that selects a single row of the display and sets all of the pixels in that row to the ON state. Subsequently, a two-step selective erase cycle occurs to set the appropriate pixels in that row to correspond to the data.

Referring now to FIG. 11, in combination with FIG. 10, time T1 is the beginning of the write row cycle where the YSa pulse is raised high. This is a normal sustain transition that causes all ON pixels in the display to discharge. At T2, a large negative pulse is applied to the selected YAa electrode. All other YA electrodes in the display remain at the initial +100 volt level. This negative pulse causes coupling cell $C_2$ to discharge because of the large voltage appearing between YSa and YAa. This discharge causes wall voltage changes on the dielectrics that cover YSa and YAa with YSa acquiring a negative wall voltage and YAa, a positive wall voltage. Because the YSa electrode is in common with pixel P, the negative wall voltage on YSa reaches a level that corresponds to the ON state for pixel P. Thus, the discharge of coupling cell $C_2$ causes the writing of pixel P. Note there is a wall voltage transition associated with the YAa pulse at T2 for all of the cells that are associated with the same electrodes that are in common with coupling cell $C_2$.

At T3, the large negative pulse on the selected YAa electrode is returned to its initial +100 volt level and simultaneously the YSb electrode is raised to 100 volts. These transitions do not cause any discharge activity because none of the cells have sufficient voltage across them.

At time T4, the YSa electrode is returned to 0 volts. This is a normal sustain transition that causes all the ON pixels in the panel to discharge. Since the row of pixels that are addressed during this write cycle have a wall charge on them deposited during the YAa pulse at time T2, those pixels discharge just as if they are in the ON state and continue to discharge on sustain transitions until an erase pulse occurs. The sustain transition at T4 also causes the wall voltage at coupling cell $C_2$ to return to near its initial state which occurred before the T2 address cycle.

Once the selected row of pixels is turned on and has stabilized, the selective erase waveforms are applied. Time T5 marks the beginning of the selective erase cycle with a rise of YSa and the fall of YSb. This is a normal sustain transition that causes all P pixels in the display to discharge. The sustain discharge leaves a positive wall charge on the dielectric covering the YSb electrode which will be employed during subsequent phases of the erase cycle. Note that this sustain discharge causes small wall voltage transitions in the coupling cells because they have common electrodes with the discharging pixel. The address cell does not show significant wall voltage change at this time because the XAa and YAa electrodes do not change, and also the wall voltage in the address cell has already come to equilibrium.

Step 1 of the erase cycle starts at time T6 with a negative going pulse applied to the selected YA electrode. If the pixel is to be erased, then a positive 100 volt pulse is applied to the XA electrode that intersects the selected pixel. If the pixel is to remain in the ON state, then no XA pulse is applied. Time T6 shows the waveforms applied when the selected pixel is to be erased. The XAa and YAa pulses add across the A address cell to discharge it. In this case, the XAa electrode is the anode, and its potential is nearly equal for the locations corresponding to the $C_1$, A and $C_4$ coupling cells. This means that plasma coupling occurs and the plasma spreads from address cell in both directions towards coupling cells $C_1$ and $C_4$ thereby causing negative charges to be deposited on the XAa dielectric in the regions of the $C_1$ and $C_4$ coupling cells.

The second step of the erase cycle commences at time T7. The XAa and YAa pulses are returned to their initial levels of 0 volts and +100 volts respectively. Also the YSb pulse rises to the +100 volt level which, in combination with the negative charge deposited on the XAa electrode due to plasma coupling at T6 and the previously deposited positive wall charge on the dielectric covering the YSb electrode, causes a discharge in coupling cell $C_4$. This discharge causes electrons (a negative wall voltage) to be deposited on the YSb dielectric since it is the anode for this discharge. These electrons cancel the positive charge that was on the YSb dielectric—due to the sustain discharge at T5. Canceling this charge on YSb results in altering the wall voltage of pixel P so that it goes to the OFF state. The waveforms transitions at T7 also cause a discharge at address cell A. In this discharge, the wall voltage of the address cell is returned to its initial level before the application of the pulse at T6.

At T8, a normal sustain transition due to the fall of the YSa pulse occurs. All of the ON pixels in the panel discharge; however, the pixel which was just erased shows no discharge activity. At T9, a normal sustain discharge again occurs for all of the ON pixels in the panel. Time T9 represents the start of a new cycle which could be either a write row cycle, a selective erase cycle, or a normal sustain cycle.

The display panel shown in FIGS. 8 and 10 has a number of advantages. It enables the employment of high impedance address drivers; exhibits low sustain capacitance characteristics and, due to the use of paired sustain conductors, has a potentially higher panel yield. Its major negative is that it does not allow for any reduction in the number of address drivers.

Referring now to FIG. 9 in conjunction with FIGS. 12 and 13, a further embodiment of this invention will be described. As in FIG. 8, all Y dimension electrodes reside on one substrate whereas the X drive electrodes reside on the other substrate. As in FIG. 8, barriers 110, 112, and 114 are provided to prevent the spread of plasma discharges. Each of the discharge pixels is noted by a dashed circle. Referring to FIG. 12, a cross-section of the display panel shown in FIG. 9, indicates the position of various coupling cells $C_1$ -$C_6$ and pixel discharge sites P1 and P2. In addition, address cell A exists between drive electrodes YAa and XAa. Address cell A in this instance controls two display pixels P1 and P2. The choice of which pixel is to be addressed is determined by the phase of the sustain voltages applied to electrodes YSa and YSb. This allows the number of Y address drivers to be reduced by a factor of 2 over the design shown in FIG. 8. In this circuit, however, the advantages gained by virtue of the provision of coupled sustain electrodes is not present.

In FIG. 13, the waveforms are illustrated which drive the circuit of FIGS. 9 and 12. These waveforms illustrate three cycles used to drive the display in a video mode. The cycles consist of a "Write Two Rows" cycle that turns on all of the pixels in two selected rows. The following two erase cycles are employed to erase pixels in each of these two rows depending on the video data.

The write two rows cycle begins with a rise on the YSa electrode which causes a normal sustain discharge in all of the pixels in the panel that are in the ON state. At T2, a large positive pulse is placed on a single selected YA electrode and all other YA electrodes remain at 0 level. In this instance, the positive pulse is placed on the YAa electrode and causes a large discharge in address cell A and in coupling cells $C_3$ and $C_4$. The discharge in coupling cells $C_3$ and $C_4$ cause the deposition of positive charge on the dielectric layers which cover electrodes YSb and YSa that are on either side of the YAa electrode. Since both of these electrodes are associated with pixels P1 and P2, this positive charge alters the wall voltage of these pixels. This may be seen in FIG. 13 just after T2 as a rise in the wall voltage of P1 and a fall in the wall voltage of P2. These wall voltages appear to go in different directions for the same influx of positive charge because this charge goes on YSb for P1 and YSa for P2 (oppositely poled). Thus, the discharge which occurs at T2 acts as a write for both P1 and P2.

At time T3, the YAa potential falls and YSb rises to +100 volts. This results in a discharge in all ON pixels in the panel except those in the row associated with P2. The P2 pixels that are ON do not discharge because the positive charge deposited on the P2 YSa electrode previously cancels out the affects of the positive transition of YSb at T3. This serves to set the wall voltages of pixels P1 and P2 to the same state.

At time T4, the YSa electrodes rise to +100 volts and the YSb electrodes fall to 0. This is a normal sustain discharge that results in all ON pixels in the panel discharging (eg. P1 and P2 discharge). Time T4 marks the end of the write cycle and the beginning of the erase cycle. Intervening sustain cycles may be placed between these two cycles in order for freshly written pixels to come to an equilibrium.

At T5, the YSa potential falls and the YSb electrodes rise causing a normal sustain transition. This places a positive charge on the dielectric covering the YSa electrodes if the associated pixel is in the ON state. The positive charge on the YSa electrode of P2 will be used in the erase discharge at time T6. At T6, a +100 volt level is applied to the selected row address electrode (in this case YAa) and the YSb level falls to 0. If the P2 pixel associated with the selected XAa and YAa electrodes is to be erased, then the intersecting XAa electrode goes to 0. Alternatively, if the pixel is to remain ON, then the XAa electrode remains at +100 volts. The pulses on the XAa and YAa electrode cause a large discharge in the address cell A. Because of the positive charge on the dielectric covering, the YSa electrode associated with pixel P2, the potential of this dielectric is nearly equal to the potential of the dielectric covering the YAa electrode.

The address cell A discharge at T6 creates a plasma which couples along coupling cell $C_4$ from the YA electrode to the YSa electrode of P2. Note that in this instance, the coupling occurs between different electrodes, as contrasted to the previously described structures wherein the coupling occurred along a single electrode. This coupling deposits negative charge on the dielectric covering the YSa electrode associated with P2 and this negative charge cancels the positive charge placed there by the sustain discharge at time T5. This cancellation is an erasure of P2. P1 is not influenced by this discharge because the potential of the dielectric covering the YSb electrode associated with P1 is quite negative relative to the potential covering the YA electrode. This negative potential repels the electrons and prevents plasma coupling from influencing P1 at time T6.

At T7, (end of the erase P2 cycle and the beginning of the erase P1 cycle) the XAa and YAa address pulses are removed and the YSa potential is raised. This results in a normal sustain discharge in all pixels in the panel that are in the ON state. The discharge activity at time T8 corresponds in a similar fashion to that at T6 with the exception that during the T8 pulses, the P1 pixel is erased. In a similar fashion as for P2, pixel P1 is erased by the action of the selected address cell, discharging and causing plasma coupling along the $C_3$ coupling cell which deposits negative charge on the YSb electrode associated with pixel P1. This negative charge erases P1.

At time T9, the XAa and YAa address pulses are returned to their initial levels and YSb rises. This results in a normal sustain discharge in all pixels in the panel that are in the ON state. It also causes the wall voltages of the address cell to return to their initial value. There is no discharge activity in the erased pixels P1 and P2. Time T10 marks the end of the erase cycle and the beginning of the next cycle.

We claim:

1. An ac plasma panel comprising:

a plurality of Y sustain electrodes;

a plurality of X and Y address electrodes, intersections between said address electrodes defining address cells, each said Y address electrode positioned between and adjacent to at least two Y sustain electrodes, intersections between said X address electrodes and Y sustain electrodes defining discharge sites;

address means for applying a pulse signal between selected X and Y address electrodes of sufficient voltage to create an intense discharge at least at one address cell, said pulse signal being poled such that said X address electrode is more positive than said Y address electrode, said discharge creating a plasma which spreads principally along said selected X electrode and deposits residual wall charges at discharge sites associated with said two adjacent sustain electrodes in dependence upon the preexisting state of wall charges at said discharge sites; and sustain means for subsequently energizing said sustain electrodes, which energization in combination with said residual wall charges selectively affects the discharge state of at least one said discharge site.

2. The invention as recited in claim 1 wherein said sustain means comprises at least two sustain signal sources, one of said sources connected to one set of sustain electrodes and the other to another set of sustain electrodes, a selected address electrode equidistantly residing between sustain electrodes connected to separate sustain signal sources, said sustain signal sources being controlled to apply sustain signals of differing phase to said respectively connected sustain electrodes.

3. An ac gas discharge device which includes a plurality of discharge sites, each site including an ionizable gas enclosed between opposing walls, the combination comprising:

first, second and third conductor means respectfully associated with discharge sites and isolated therefrom by a first dielectric layer;

fourth conductor means orthogonal to said first, second and third conductor means and isolated from said discharge sites by a second dielectric layer;

address means coupled to said second and fourth conductor means for applying a pulse address signal thereto to induce an intense plasma discharge at a discharge site associated therewith, said plasma discharge acting to migrate to discharge sites associated with said first and third conductor means along said second dielectric layer in accordance with preexisting wall charges at said discharge site, and to deposit residual wall charges at said discharge sites; and sustain means coupled to said first and third conductor means for subsequently and selectively applying a potential, which in combination with said residual wall charges, selectively creates a plasma discharge at discharge sites associated with either said first or third conductor means to deposit subsequent residual wall charges thereat.

4. The invention as defined in claim 3 wherein said sustain means comprises at least two sustain generators, a first said sustain generator coupled to said first conductor means and a second said sustain generator to said third conductor means.

5. The invention as defined in claim 4 wherein said one sustain generator and address means are controlled to create a discharge between said first and second conductor means and to deposit wall charges on said first dielectric layer at said first conductor means; and subsequently, both said sustain generators are controlled to employ said wall charges at said first conductor means to create a discharge between said first and third conductors.

6. An ac gas discharge device which includes a plurality of discharge sites, each site including an ionizable gas enclosed between opposing dielectric walls, the combination comprising:

first, second and third conductor means associated with first, second and third discharge sites respectively, said conductor means isolated from said gas by one of said dielectric walls;

fourth conductor means intersecting said first, second and third discharge sites and isolated from said gas by the other of said dielectric walls; said other dielectric wall at said first and third discharge sites exhibiting a range of initial wall voltages substantially equal to or more positive than the wall voltage at said other dielectric wall at said second discharge site;

address means for applying a voltage charge across said second and fourth conductor means to induce an intense plasma discharge at said second discharge site, said plasma discharge acting to migrate to said first and third discharge sites along said other dielectric wall associated with said fourth conductor means, and to deposit residual wall charges on said other dielectric wall at said first and third discharge sites;

sustain means for subsequently applying a voltage change between said first and fourth, and third and fourth conductor means, which voltage change is insufficient in itself to cause a plasma discharge; but does, when added to said residual wall charges, create a plasma discharge at said first and third discharge sites.

7. The invention as defined in claim 6 wherein said subsequently applied voltage by said sustain means is polled opposite to the voltage change applied by said address means.

8. The invention as defined in claim 6 wherein said first, second and third conductor means are orthogonally oriented to said fourth conductor means and said first and third conductor means are connected to separate X dimension sustain voltage sources, said fourth conductor means is connected to a Y dimension sustain voltage source and said second conductor means is connected to an address voltage source.

9. The invention as defined in claim 8 wherein said separate sustain voltage sources are operable to apply time phased signals to said conductor means.

10. The invention as defined in claim 9 wherein fifth and sixth conductor means are disposed to one side of said fourth conductor means and are respectively connected to an address voltage source and a separate sustain voltage source.

11. A gas discharge device including a plurality of discharge sites, each site including an ionizable gas enclosed between opposing dielectric walls, the combination comprising:

orthogonally oriented X and Y address conductors respectively disposed on and isolated from said gas by said dielectric walls, each intersection therebetween defining an address cell discharge site;

orthogonally oriented X and Y sustain conductors respectively disposed on and isolated from said gas by said dielectric walls, each intersection therebetween defining a pixel discharge site, each intersection between a sustain conductor and an address conductor defining a coupling cell discharge site;

address means for applying a signal pulse between a pair of selected X and Y address conductors to induce an intense plasma discharge at an address cell discharge site, said plasma discharge acting to migrate along a dielectric wall associated with one of said adress conductors to a coupling cell discharge site whose preexisting wall voltage state is in the range of sustantially equal to, to more positive than the wall voltage state at said address cell discharge site and to deposit thereon residual wall charges which create a residual wall voltage;

first sustain means for subsequently applying a sustain voltage signal between a pair of X and Y sustain conductors, one said sustain conductor intersecting said coupling cell discharge site and a pixel site and the other sustain conductor intersecting said pixel site, said applied sustain signal being sufficient to create a discharge at a selected discharge site only when added to predeposited residual wall voltage, said applied sustain voltage signal creating a plasma discharge at said coupling cell discharge site, which plasma migrates to said pixel site along said sustain conductor intersecting both said sites and deposits residual wall charges at said pixel site.

12. The invention as claimed in claim 11 further including second sustain means which substantially simultaneously with said first sustain means, applies a second sustain signal between said one sustain conductor and said other sustain conductor which intersects said one sustain conductor at an adjacent second pixel site to inhibit the action of said plasma discharge at said second pixel site.

13. The invention as defined in claim 12 wherein said X and Y sustain conductors are respectively paired sets of conductors shorted together at one end, one leg of each pair associated with an X or Y address conductor, as the case may be.

14. An ac plasma panel including an ionizable gas enclosed between sheets, one said sheet carrying electrodes for the X dimension, the other carrying orthogonally oriented electrodes for the Y dimension, said electrodes isolated from said gas by a dielectric material; said panel having plurality of addressable areas, each area comprising:

X and Y address electrodes, the intersection therof defining an address site;

$X_1$ and $X_2$ sustain electrodes symmetrically oriented on either side of said X address electrode;

$Y_1$ and $Y_2$ sustain electrodes symmetrically oriented on either side of said Y address electrode, the intersections between sustain electrodes defining display pixels and the intersections between sustain electrodes and address electrodes defining coupling sites;

address means connected to said address electrodes for applying an address signal pulse between X and Y address electrodes to create intense plasma discharges at the coupling sites defined by the intersections of said Y address electrode and the $X_1$ and $X_2$ sustain electrodes, which discharges act to deposit wall charges at adjacent pixel sites; and sustain driver means connected to said Y sustain electrodes for subsequently applying a sustain potential to said sustain electrodes to switch said adjacent pixel sites to the on state.

15. An ac plasma panel comprising:

a plurality of intersecting address electrodes, intersections between said address electrodes defining address cells;

a plurality of intersecting sustain electrodes; each address electrode positioned between adjacent sustain electrodes;

intersections between address electrodes and sustain electrodes defining coupling cells and intersections between sustain electrodes defining display cells;

address means for applying a high voltage signal pulse between selected intersecting address electrodes to intensely discharge at least one address cell, the plasma created by said discharge depositing residual wall charges at coupling cells defined by intersections between one said address electrode and two sustain electrodes;

sustain means for subsequently energizing intersecting sustain electrodes to cause said coupling cells to selectively aid the discharge of one or more adjacent display cells.

16. The invention as recited in claim 15 wherein said sustain means comprises at least two sustain signal sources, one of said sources connected to a pair of sustain electrodes on one side of a selected address electrode and the other to a pair of sustain electrodes on the other side of said selected address electrode, said sustain signal sources being phased to apply sustain signals to said display cells to prevent plasma coupling from affecting the state of selected cells.

17. The invention as defined in claim 16 wherein said sustain signal sources are sequentially controlled to enable plasma coupling into each display cell in subsequent address cycles.

18. The invention as defined in claim 17 wherein the display cells adjacent each address cell are dominated ($P_1$, $P_2$, $P_4$ and $P_3$) in clockwise manner and the coupling cells are denominated ($C_1$, $C_3$, $C_4$ and $C_2$) in clockwise manner, with $C_1$ being between $P_1$ and $P_2$, wherein said address means and sustain voltage sources are so phased as to discharge $C_1$, $C_1$, $C_4$, $C_4$ during sequential address cycles.

19. The invention as defined in claim 18 wherein said address means and sustain voltage sources are so phased as to discharge $C_2$, $C_3$, $C_2$, $C_3$ during sequential address cycles.

20. The invention as defined in claim 16 wherein said address means includes coincidence gate means associated with each address electrode and serial shift register means communicating with said gate means to provide address signals.

21. The invention as defined in claim 20 wherein said coincidence gate means employ said ionizable gas in their operation.

22. The invention as defined in claim 21 wherein said coincidence gate means employ said ionizable gas to store a wall charge state in gate means.

23. An ac plasma panel including an ionizable gas enclosed between dielectric walls comprising:

first, second and third adjacent electrodes spaced apart and oriented in a first direction and a fourth electrode oriented in a direction orthogonal to said first direction, all said electrodes isolated from said gas by said dielectric walls, a plurality of discharge cells being defined in the vicinity of said fourth electrode as follows: an address cell between said second and fourth electrodes; a first coupling cell between said first and fourth electrodes; a second coupling cell between said first and second electrodes; a third coupling cell between said second and third electrodes; a fourth coupling cell between said third and fourth electrodes and a display cell between said first and third electrodes;

address drivers connected to said second and fourth electrodes for inducing an intense discharge of said address cell, which discharge is coupled to said first and fourth coupling cells to deposit residual wall voltages;

phased sustain drivers connected to said first and third electrodes for applying sustain potentials to selectively discharge at least one of said coupling cells evidencing said residual wall voltage.

24. The invention as defined in claim 23, further including means for controlling said address drivers and sustain drivers to initiate a discharge of said second coupling cell to deposit residual wall voltage therein, and subsequently to apply a voltage across said display cell, which when combined with said residual wall voltage, results in a discharge of said display cell.

25. The invention as defined in claim 24, wherein said sustain drivers are phased to apply a sustain potential across said first or fourth coupling cell to discharge said cell and to set said display cell to the off state.

26. An ac plasma panel including an ionizable gas enclosed between dielectric walls, comprising;

first through fifth adjacent electrodes spaced apart and oriented in the X direction and a sixth electrode oriented in the Y direction, all said electrodes isolated from said gas by said dielectric walls, a plurality of discharge sites being defined in the vicinity of said sixth electrode as follows:

first, second, fifth and sixth coupling cells between said sixth electrode and said first, second, fourth and fifth electrodes respectively; third and fourth coupling cells between said third electrode and said second and fourth electrodes respectively; first and second display cells between said first and second electrodes and said fourth and fifth electrodes respectively; and an address cell between said third and sixth electrodes;

address drivers connected to said third and sixth electrodes for inducing an intense discharge plasma in said address cell and said third and fourth coupling cells;

first and second sustain means connected to said first and fourth electrodes and said second and fifth electrodes respectively, for applying signals to cause said first and second display cells to discharge and to acquire residual wall charges.

27. The invention as defined in claim 26 wherein said address means causes a further discharge plasma at said address cell, said discharge plasma coupling to the second electrode or fourth electrode dependent upon the state of residual wall charges thereat whereby the display pixel associated with the electrode to which said plasma is coupled is switched to an off state.

28. The invention as defined in claim 26 wherein said first and second sustain drivers cooperate to apply a potential across said first display cell to switch it to the on state and subsequently again cooperate to apply a potential across said second display cell to switch it to the on state.

* * * * *